US008608436B2

(12) United States Patent
Wines et al.

(10) Patent No.: US 8,608,436 B2
(45) Date of Patent: Dec. 17, 2013

(54) TAPERED COLLET CONNECTION OF ROTOR COMPONENTS

(75) Inventors: Daniel Edward Wines, Cincinnati, OH (US); James Hamilton Grooms, Hamilton, OH (US); Craig William Higgins, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 676 days.

(21) Appl. No.: 12/872,376

(22) Filed: Aug. 31, 2010

(65) Prior Publication Data

US 2012/0051917 A1 Mar. 1, 2012

(51) Int. Cl.
*F01D 5/02* (2006.01)
*F01D 11/00* (2006.01)

(52) U.S. Cl.
USPC ..... 415/174.2; 416/221

(58) Field of Classification Search
USPC ..... 415/173.7, 174.1, 174.2, 174.3, 174.5; 416/220 R, 221
See application file for complete search history.

(56) References Cited

U.S. PATENT DOCUMENTS

| | | | | |
|---|---|---|---|---|
| 3,814,539 | A * | 6/1974 | Klompas | 416/95 |
| 4,088,422 | A * | 5/1978 | Martin | 416/198 A |
| 4,480,958 | A * | 11/1984 | Schlechtweg | 416/220 R |
| 5,236,302 | A | 8/1993 | Weisgerber et al. | |
| 5,318,405 | A | 6/1994 | Meade et al. | |
| 5,320,488 | A | 6/1994 | Meade et al. | |
| 5,338,154 | A | 8/1994 | Meade et al. | |
| 5,800,124 | A * | 9/1998 | Zelesky | 416/95 |
| 6,065,928 | A | 5/2000 | Rieck, Jr. et al. | |
| 6,283,712 | B1 | 9/2001 | Dziech et al. | |
| 6,464,453 | B2 * | 10/2002 | Toborg et al. | 415/115 |
| 6,520,743 | B2 * | 2/2003 | Arilla et al. | 416/220 R |
| 6,769,865 | B2 | 8/2004 | Kress et al. | |
| 6,884,028 | B2 * | 4/2005 | Brauer et al. | 415/173.7 |

(Continued)

FOREIGN PATENT DOCUMENTS

| | | |
|---|---|---|
| EP | 0169801 A1 | 1/1986 |
| EP | 0801208 A2 | 10/1997 |
| EP | 1273815 A2 | 1/2003 |
| EP | 1801347 A2 | 6/2007 |

OTHER PUBLICATIONS

International Search Report, Patent Cooperation Treaty, Global Patent Operation, Received Oct. 13, 2011.

*Primary Examiner* — Edward Lock
*Assistant Examiner* — Christopher R Legendre
(74) *Attorney, Agent, or Firm* — General Electric Company; Steven J. Rosen

(57) ABSTRACT

A connection between an annular sleeve on a gas turbine engine first rotor component includes an annular tapered conical slot extending axially inwardly into the sleeve from an annular opening and tapers axially into the sleeve from the opening. An annular rim of a second rotor component is received within the conical slot and includes a rim inner conical surface mating with and contacting a sleeve inner conical surface in part bounding the conical slot. A sleeve cylindrical outer surface in part bounds the conical slot in the sleeve and a rim outer cylindrical surface on the annular rim contacts the sleeve cylindrical outer surface. An annular lip may extend radially inwardly from the sleeve and sleeve inner conical surface at the annular opening to the conical slot. The connection may be used between a first stage disk and an interstage seal.

15 Claims, 4 Drawing Sheets

(56) References Cited

U.S. PATENT DOCUMENTS 6,899,520 B2 5/2005 Habedank et al.
7,458,774 B2 * 12/2008 Albrecht et al. ..... 416/1
8,459,953 B2 * 6/2013 Haffner ..... 416/220 R
2003/0007827 A1 * 1/2003 Broadhead et al. ..... 403/13
2012/0051917 A1 * 3/2012 Wines et al. ..... 416/179

* cited by examiner

TAPERED COLLET CONNECTION OF ROTOR COMPONENTS

BACKGROUND OF THE INVENTION

1. Field of the Invention

This invention relates to connecting aircraft gas turbine engine rotor components.

2. Discussion of the Background Art

Gas turbine engines frequently have multi-stage turbine rotors having adjacent co-rotating components such as interstage seals located between adjacent first and second stage turbine disks. The interstage seal may be connected to the first stage disk and the second stage disk by boltless connections, thereby, eliminating the time-consuming task of properly torquing the bolts and eliminating the stress concentration problems associated with bolted connections. An example of such a connection is disclosed in U.S. Pat. No. 5,320,488, titled "Turbine Disk Interstage Seal Anti-rotation System", by Meade et al., and issued Jun. 14, 1994.

Aircraft engine rotors carry large torque loads and separate torque loads applied to separate components must be carried though the interfaces or connections connecting the components to avoid component slipping. If components slip at the connecting or mating interfaces hardware may be damage and is subject to fretting.

Anti-rotation or torque and slip countering features such as keys, tabs, or splines to carry torque are well known in the art. Boltless connections also incorporate rabbets and their interfaces are loaded with friction to avoid slipping. These features are costly three dimensional features and splines and tabs are also highly stressed.

Accordingly, there is a need for a turbine engine rotor boltless connection between rotor components that provides improved anti-rotation or torque and slip effectiveness and is more robust in countering rotation and associated rotational slippage than rabbets. There is also a need for boltless connections that are less expensive and less complicated than three dimensional features such as splines and tabs.

SUMMARY OF THE INVENTION

A gas turbine engine rotor assembly includes a first rotor component connected to a second rotor component by a connection. The connection includes an annular sleeve on the first rotor component, an annular tapered conical slot extending axially inwardly into the sleeve from an annular opening of the slot, the tapered conical slot tapering axially into the sleeve from the opening, and a sleeve inner conical surface in part bounding the conical slot. The second rotor component includes an annular rim received within the conical slot the annular rim and a rim inner conical surface mating with and pressing against the sleeve inner conical surface.

The assembly may further includes a sleeve cylindrical outer surface in part bounding the conical slot in the sleeve and a rim outer cylindrical surface on the annular rim. The annular rim outer cylindrical surface mates with and contacts the sleeve cylindrical outer surface.

An annular lip extending radially inwardly from the sleeve and sleeve inner conical surface at the annular opening to the conical slot may be incorporated.

The connection may be used in a gas turbine engine rotor assembly including an interstage seal axially disposed between and connected to first and second stage disks circumscribed about a centerline axis. The annular sleeve may be on the first stage disk and the interstage seal and the annular rim on the interstage seal.

The annular rim may be on a forward arm extending axially from an annular outer shell of the interstage seal towards the first stage disk. The sleeve may be on an aft boltless blade retainer mounted on the first stage disk.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DETAILED DESCRIPTION

Figure 1:
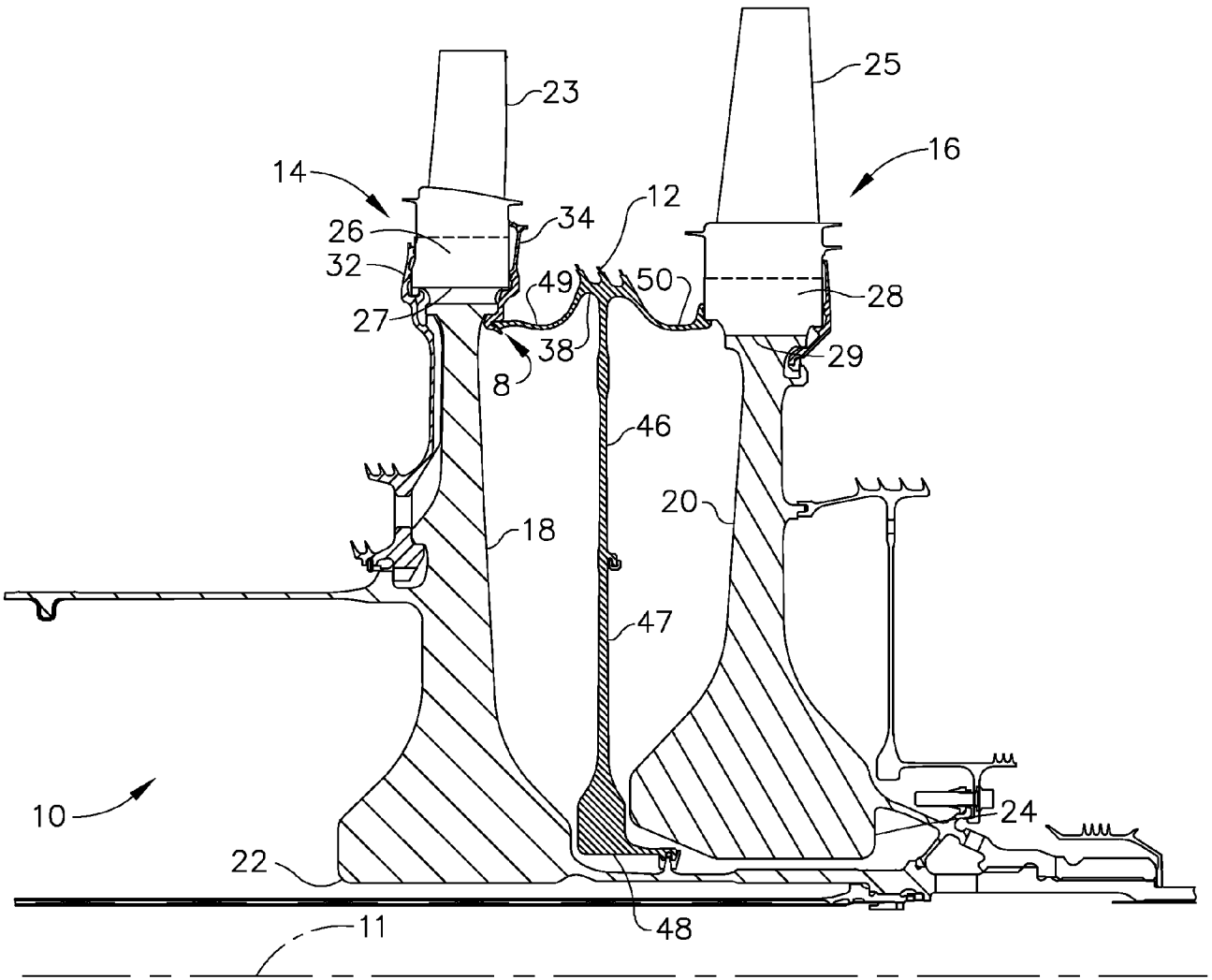
FIG. 1 is a cross-sectional view illustration of a gas turbine engine with first and second high pressure turbine stages and an interstage seal therebetween connected to the first stage turbine with a tapered collet boltless connection.

Illustrated in FIG. 1 is an exemplary embodiment of a collet boltless connection 8 for gas turbine engine rotor components. A gas turbine engine rotor assembly 10 circumscribed about a centerline axis 11 of a gas turbine engine includes an interstage seal 12 axially disposed between and connected to first and second stage disks 14, 16. First and second webs 18, 20 of the first and second stage disks 14, 16 extend radially outward from first and second bores 22, 24, respectively. The first and second webs 18, 20 each terminate in an outer periphery having a plurality of first and second turbine blades 23, 25 received in first and second slots 26, 28 in first and second disk rims 27, 29 of the first and second stage disks 14, 16 respectively.

Figure 2:
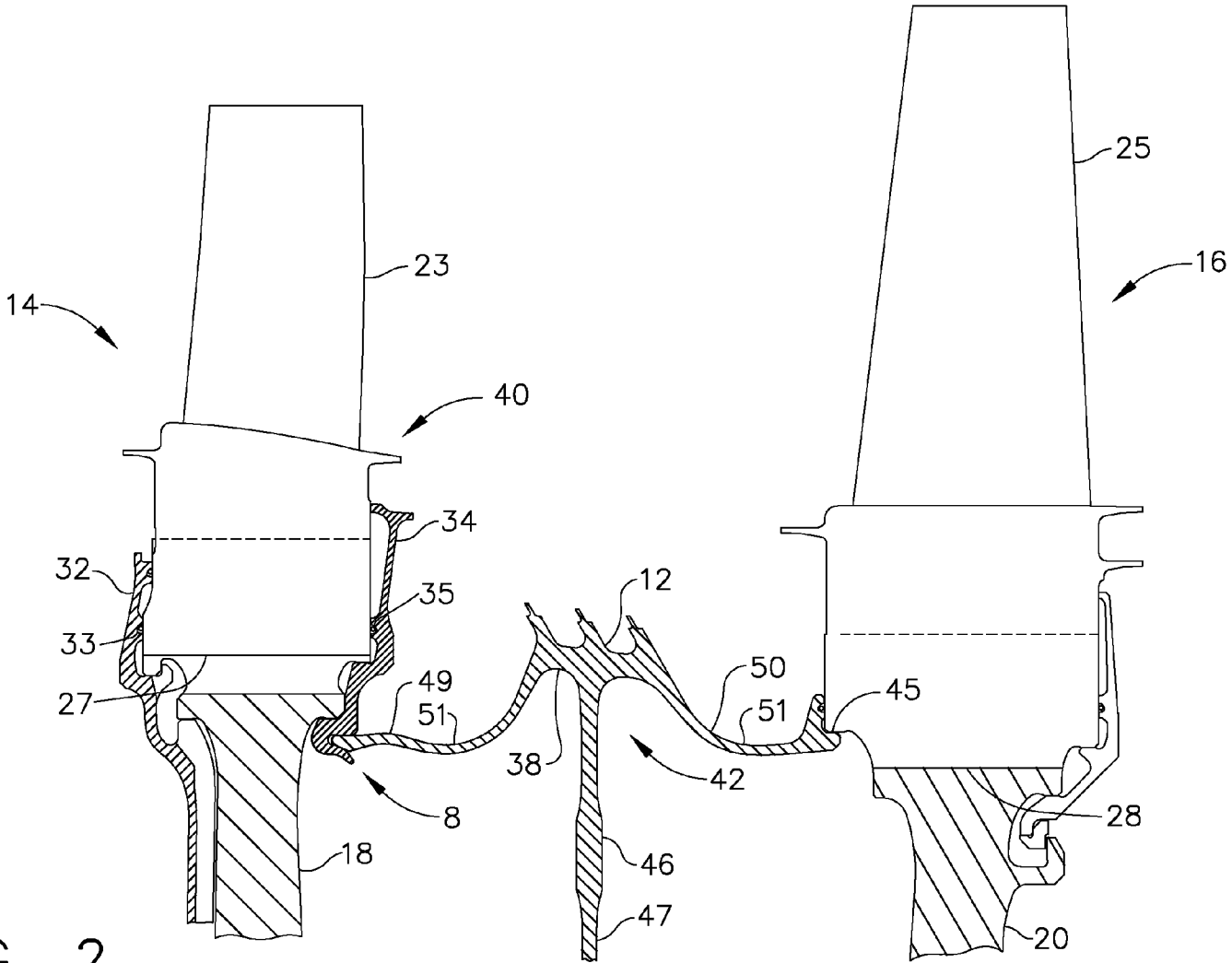
FIG. 2 is an enlarged cross-sectional view illustration of the interstage seal illustrated in FIG. 1.
Figure 3:
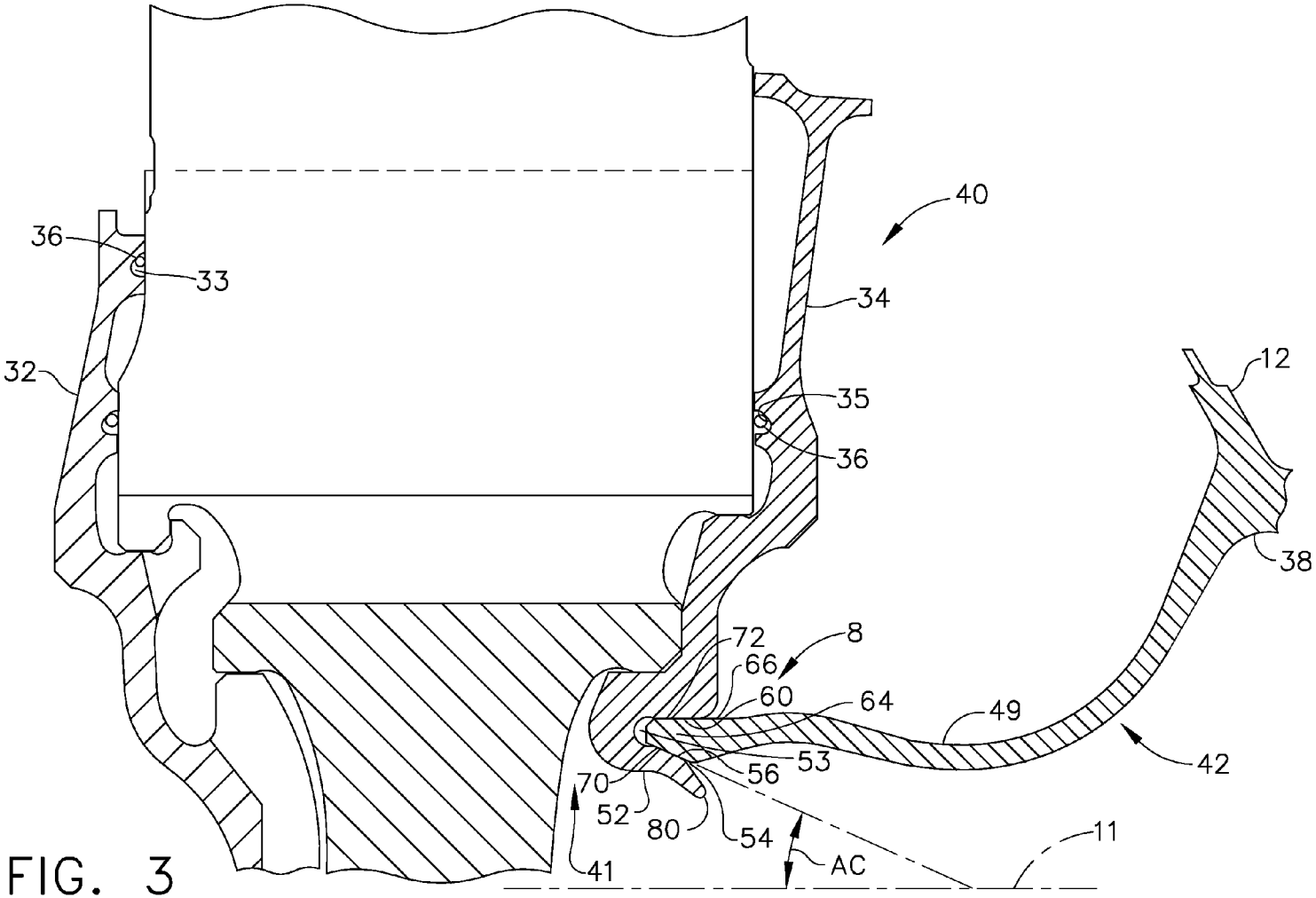
FIG. 3 is an enlarged cross-sectional view illustration of the boltless connection illustrated in FIG. 2.

Referring to FIGS. 2 and 3, forward and aft boltless blade retainers 32, 34 mounted on the first disk rim 27 retains the first turbine blades 23 in the first slots 26. The forward and aft boltless blade retainers 32, 34 include forward and aft recesses 33, 35 respectively for containing wire seals 36. A first rotor component 40 is exemplified by a first stage disk assembly 41 including the first stage disk 14 and its blades and boltless blade retainers. A second rotor component 42 is exemplified by the interstage seal 12. The collet boltless connection 8 connects the first and second rotor components 40, 42. A rabbet connection 45 is used to connect the interstage seal 12 to the second stage disk 16.

Referring to FIGS. 1, 2, and 3, the interstage seal 12 includes an outer shell 38 and a seal disk 46 having a seal web 47 and a seal bore 48. A forward arm 49 extends axially forwardly from the outer shell 38 towards the first stage disk 14 and is connected to the aft boltless blade retainer 34 on the first stage disk 14 by the collet boltless connection 8. An aft arm 50 extends axially aftwardly from the outer shell 38 towards the second stage disk 16 and is connected to the second disk rim 29 of the second stage disk 16 by the rabbet connection 45.

The shell 38 is generally cylindrical in shape, and the forward and aft arms 49, 50 each have an inwardly convex shape. More specifically, the forward and aft arms 49, 50 each have a catenary curve 51 which extends from the shell 38 to the respective first and second stage disks 14, 16.

Figure 4:
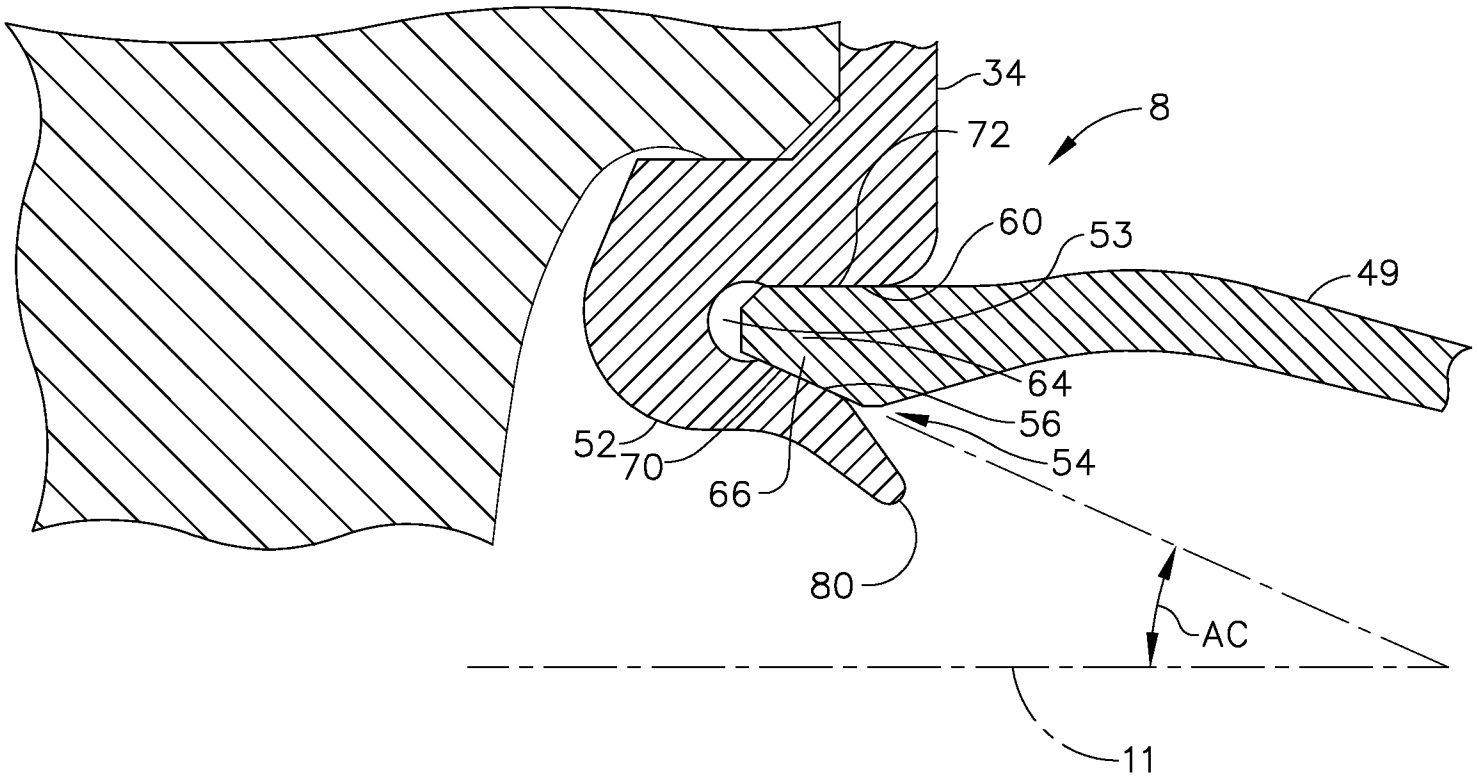
FIG. 4 is an enlarged cross-sectional view illustration of a rim of the interstage seal received in the tapered collet illustrated in FIG. 3.

Referring to FIGS. 3 and 4, the collet boltless connection 8 includes an annular sleeve 52 on the aft boltless blade retainer 34. The annular sleeve 52 includes a tapered conical slot 53 extending axially inwardly into the sleeve from an annular opening 54. The conical slot 53 tapers axially into the sleeve 52 from the opening 54. The sleeve 52 includes a sleeve radially inner conical surface 56 in part bounding the conical slot 53. The embodiment of sleeve 52 illustrated herein further includes a sleeve cylindrical outer surface 60 juxtaposed to the sleeve inner conical surface 56. The sleeve cylindrical outer surface 60 in part bounds the conical slot 53 in the sleeve 52.

The collet boltless connection 8 further includes an annular tapered rim 64 on a forward end 66 of the forward arm 49. The rim 64 is received within the conical slot 53 in the sleeve 52. The rim 64 includes a radially inwardly facing rim inner conical surface 70 and a radially outwardly facing rim outer cylindrical surface 72. The rim inner conical surface 70 mates with, contacts, and presses against the sleeve inner conical surface 56 The entire annular tapered rim 64 tapers axially away from the annular outer shell 38.

The rim inner conical surface 70 and the sleeve inner conical surface 56 have substantially the same conical angle AC with respect to the centerline axis 11. There may be a small difference between the conical angles of the rim inner conical surface 70 and the sleeve inner conical surface 56 to accommodate radial deflection. The rim outer cylindrical surface 72 mates with and contacts the sleeve cylindrical outer surface 60. The connection 8 locks or secures the annular rim 64 on the forward arm 49 of the interstage seal 12 within the conical slot 53 in the sleeve 52 of the first stage disk assembly 41 thus preventing or resisting circumferential slipping between and related fretting of the mating surfaces.

An annular lip 80 extends axially aftwardly from the sleeve inner conical surface 56 and tapers and extends radially inwardly from sleeve inner conical surface 56 at the annular opening 54 to the conical slot 53. The annular lip 80 is provided to allow a tool to be used to disassemble and separate the first and second rotor components 40, 42 and more particularly the rim 64 from the sleeve 52.

While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A gas turbine engine rotor assembly comprising:

first and second rotor components circumscribing a centerline axis, the first rotor component including an annular sleeve on the first rotor component, an annular tapered conical slot extending axially inwardly into the sleeve from an annular opening of the slot, the tapered conical slot tapering axially into the sleeve from the opening, the sleeve including a sleeve inner conical surface in part bounding the conical slot, the second rotor component including an annular rim received within the conical slot, the annular rim including a rim inner conical surface mating with and pressing against the sleeve inner conical surface, a sleeve cylindrical outer surface in part bounding the conical slot in the sleeve, a rim outer cylindrical surface on the annular rim, and the annular rim outer cylindrical surface mating with and contacting the sleeve cylindrical outer surface.

2. An assembly as claimed in claim 1, further comprising an annular lip extending radially inwardly from the sleeve and sleeve inner conical surface at the annular opening to the conical slot.

3. A gas turbine engine rotor assembly comprising:

an interstage seal axially disposed between and connected to first and second stage disks circumscribed about a centerline axis, an annular sleeve on the first stage disk, an annular tapered conical slot extending axially inwardly into the sleeve from an annular opening of the slot, the tapered conical slot tapering axially into the sleeve from the opening, the sleeve including a sleeve inner conical surface in part bounding the conical slot, the interstage seal including an annular rim received within the conical slot, and the annular rim including a rim inner conical surface mating with and pressing against the sleeve inner conical surface.

4. An assembly as claimed in claim 3, further comprising:

a sleeve cylindrical outer surface in part bounding the conical slot in the sleeve, a rim outer cylindrical surface on the annular rim, and the annular rim outer cylindrical surface mating with and contacting the sleeve cylindrical outer surface.

5. An assembly as claimed in claim 4, further comprising an annular lip extending radially inwardly from the sleeve and sleeve inner conical surface at the annular opening to the conical slot.

6. An assembly as claimed in claim 3, further comprising the annular rim on a forward arm extending axially from an annular outer shell of the interstage seal towards the first stage disk.

7. An assembly as claimed in claim 6, further comprising an aft boltless blade retainer mounted on the first stage disk and the blade retainer including the sleeve.

8. An assembly as claimed in claim 7, further comprising:

a sleeve cylindrical outer surface in part bounding the conical slot in the sleeve, a rim outer cylindrical surface on the annular rim, and the annular rim outer cylindrical surface mating with and contacting the sleeve cylindrical outer surface.

9. An assembly as claimed in claim 8, further comprising an annular lip extending radially inwardly from the sleeve and sleeve inner conical surface at the annular opening to the conical slot.

10. A gas turbine engine turbine disk annular blade retainer comprising:

a retainer circumscribing a centerline axis, an annular sleeve on the blade retainer, an annular tapered conical slot extending axially inwardly into the sleeve from an annular opening of the slot, the tapered conical slot tapering axially into the sleeve from the opening, the sleeve including a sleeve inner conical surface in part bounding the conical slot, the sleeve including a sleeve cylindrical outer surface in part bounding the conical slot, and an annular lip extending axially away from the sleeve inner conical surface and tapering and extending radially inwardly from the sleeve inner conical surface at the annular opening to the conical slot.

11. An interstage seal comprising:

a seal circumscribing a centerline axis, a forward arm extending axially from an annular outer shell of the interstage seal, the forward arm including an annular tapered rim, the entire annular tapered rim tapering axially away from the annular outer shell, and the annular tapered rim including a radially inwardly facing rim inner conical surface.

12. An interstage seal as claimed in claim 11, further comprising the annular tapered rim including a radially outwardly facing rim outer cylindrical surface.

13. A gas turbine engine turbine disk annular blade retainer comprising:

a retainer circumscribing a centerline axis, an annular sleeve on the blade retainer, an annular tapered conical slot extending axially inwardly into the sleeve from an annular opening of the slot, the tapered conical slot tapering axially into the sleeve from the opening, the sleeve including a sleeve inner conical surface in part bounding the conical slot, the retainer including an aft recess for containing a wire seal, the annular tapered conical slot extending axially forwardly into the sleeve from the annular opening of the slot, and the tapered conical slot tapering axially forwardly into the sleeve from the opening.

14. A blade retainer as claimed in claim 13, further comprising a sleeve cylindrical outer surface in part bounding the conical slot in the sleeve.

15. A blade retainer as claimed in claim 13, further comprising an annular lip extending radially inwardly from the sleeve and sleeve inner conical surface at the annular opening to the conical slot and the annular lip extending axially aftwardly away from the sleeve inner conical surface.

* * * * *

UNITED STATES PATENT AND TRADEMARK OFFICE

CERTIFICATE OF CORRECTION

PATENT NO. : 8,608,436 B2
APPLICATION NO. : 12/872376
DATED : December 17, 2013
INVENTOR(S) : Wines et al.

It is certified that error appears in the above-identified patent and that said Letters Patent is hereby corrected as shown below:

In The Specification

In Column 1, Line 54, delete “includes” and insert -- include --, therefor.

In Column 3, Lines 19-20, delete “conical surface 56” and insert -- conical surface 56. --, therefor.

Signed and Sealed this
Fifth Day of May, 2015

Michelle K. Lee

Michelle K. Lee
*Director of the United States Patent and Trademark Office*